US007403725B2

(12) United States Patent
Wilson et al.

(10) Patent No.: US 7,403,725 B2
(45) Date of Patent: Jul. 22, 2008

(54) IMAGING DRUM DRIVING METHODS AND APPARATUS PROVIDING AUTOMATED SETTING OF CONTROL PARAMETERS

(75) Inventors: David Craig Wilson, Vancouver, BC (CA); Gerald Floyd Cummings, Port Moody (CA); Michael Scott Bogelund, Surrey (CA)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 453 days.

(21) Appl. No.: 10/759,149

(22) Filed: Jan. 20, 2004

(65) Prior Publication Data

US 2004/0165896 A1 Aug. 26, 2004

Related U.S. Application Data

(60) Provisional application No. 60/449,858, filed on Feb. 27, 2003.

(30) Foreign Application Priority Data

Feb. 25, 2003 (CA) ..... 2419686

(51) Int. Cl.
*B41N 6/00* (2006.01)

(52) U.S. Cl. ..... 399/36; 101/401.1; 101/415.1; 358/3.29

(58) Field of Classification Search ..... 399/36, 399/167; 101/401.1, 463.1; 358/3.29
See application file for complete search history.

(56) References Cited

U.S. PATENT DOCUMENTS

| | | | | |
|---|---|---|---|---|
| 5,294,969 | A * | 3/1994 | Ito | 399/36 |
| 5,508,784 | A * | 4/1996 | Matsuoka et al. | 399/130 |
| 6,443,067 | B2 * | 9/2002 | Kimura | 101/415.1 |
| 6,684,784 | B2 | 2/2004 | Salvestro | |
| 6,760,559 | B2 * | 7/2004 | Koide | 399/165 |
| 6,868,244 | B2 * | 3/2005 | Koide | 399/167 |
| 7,273,689 | B2 * | 9/2007 | Wieland et al. | 430/270.1 |
| 2002/0057924 | A1 * | 5/2002 | Ueno et al. | 399/117 |
| 2002/0196473 | A1 * | 12/2002 | Patten et al. | 358/3.29 |

* cited by examiner

*Primary Examiner*—Quana M Grainger
(74) *Attorney, Agent, or Firm*—Donna P. Suchy

(57) ABSTRACT

In a drum based imaging system where it may be necessary to change the drum to accommodate different imaging media sizes there is a need to adapt the drum rotational drive system to control the new drum load. An automated process for updating the control parameters without requiring user intervention uses parameter identification or adaptive control to identify or characterize the new drum load.

33 Claims, 3 Drawing Sheets

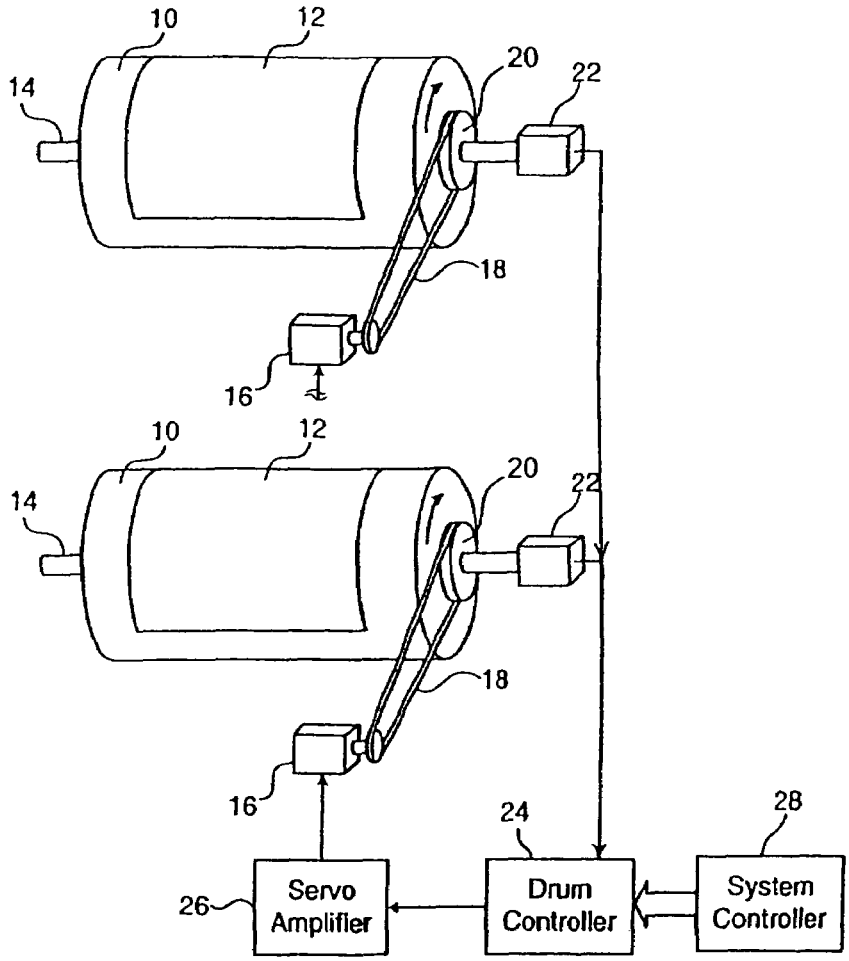
FIG. 1-A
PRIOR ART
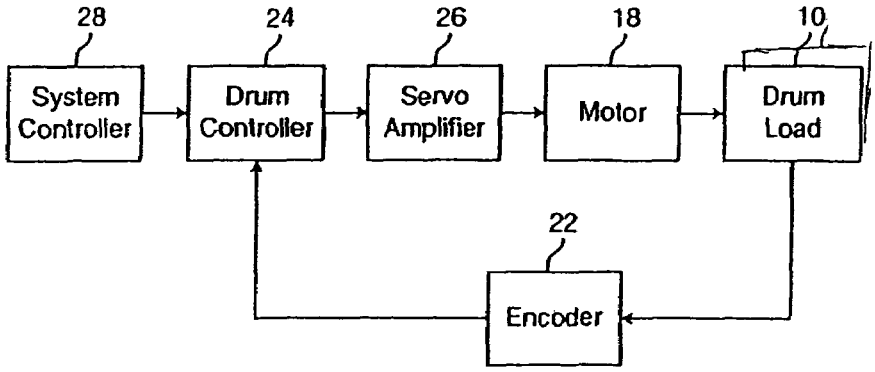
FIG. 1-B
PRIOR ART

IMAGING DRUM DRIVING METHODS AND APPARATUS PROVIDING AUTOMATED SETTING OF CONTROL PARAMETERS

RELATED APPLICATIONS

This application claims benefit of the filing date of U.S. Application No. 60/449,858 provisionally filed on Feb. 27, 2003 and entitled Method for driving an imaging drum. This application also claims benefit of the filing date of Canadian Application 2419686 filed on Feb. 25, 2003.

TECHNICAL FIELD

The invention relates to the field of imaging devices and more particularly to imaging devices having a drum for rotating an imaging media.

BACKGROUND

Imaging systems that employ a drum to scan an imaging media past a writing head are well known in the art. Commonly the imaging head does not have enough imaging beams to write the entire width of the drum in a single rotation and hence the writing head is translated in a direction aligned with the drum axis to address the entire surface of the media.

It is important, particularly in high resolution imaging systems, to provide accurate and consistent rotation of the drum load to achieve acceptable imaging results. As an example, in Computer to Plate imaging systems, where a printing plate precursor is imaged by a laser based exposure head, a commonly used resolution is 2400 dpi. A common drum format used in such systems is a 32-inch circumference and 44-inch wide drum made from cast aluminium. Speed regulation of around 0.5% has found to be sufficient for imaging at these high resolutions. Furthermore, good positional control may also be required for loading and unloading imaging media in a system wherein media handling is automated.

A rotational drive system for an imaging drum will commonly employ servo control means to ensure that the drum rotates at a consistent speed. Such servo systems are well known in the art.

A problem arises in recently emerging imaging systems that have facilities for changing the drum during normal operation. One such system is the ThermoFlex® imaging system sold by Creo Inc. of Burnaby, BC, Canada. The ThermoFlex® system is presently being upgraded with the capability of imaging on a drum or on a sleeve. A sleeve is simply a media that is supplied attached to a tubular substrate rather than the more conventional flat plate format. To accommodate differing sleeve diameters, a variety of different sized drums are provided. In practice, a drum shell of the correct diameter is loaded onto a common mandrel in order to support a particular sleeve.

Whenever the drum load is changed the control parameters for the rotational drive system must also be changed since these parameters are typically set for a specific load and may not work with the new load. This is an inconvenience for the user and there remains a need for a method to easily accommodate the change between different drum loads.

SUMMARY OF THE INVENTION

In a first aspect of the invention a method for accommodating different drum loads in an imaging device is provided. The method involves applying a drive stimulus to the drum load and monitoring the response of the drum load to the stimulus. A new value for at least one control parameter for driving the drum load is determined and the control parameter is updated in accordance with the new value.

In another aspect of the invention a system for driving a drum load has a drum drive for driving the load, an encoder for sensing the resulting rotation of the drum, and a controller operably connected to the drum drive to provide control signals thereto. The control signals are derived by the controller in response to rotational information received from the encoder. The controller has a drive parameter estimator for determining suitable drive conditions for the load.

For an understanding of the invention, reference will now be made by way of example to a following detailed description in conjunction by accompanying drawings.

BRIEF DESCRIPTION OF THE DRAWINGS

In drawings which illustrate by way of example only preferred embodiments of the invention:

FIG. 1-A is a front perspective view of a prior art imaging drum drive system.

FIG. 1-B is a schematic diagram of a prior art control system for the drum drive system shown in FIG. 1.

DESCRIPTION OF THE PREFERRED EMBODIMENTS

Figure 2:
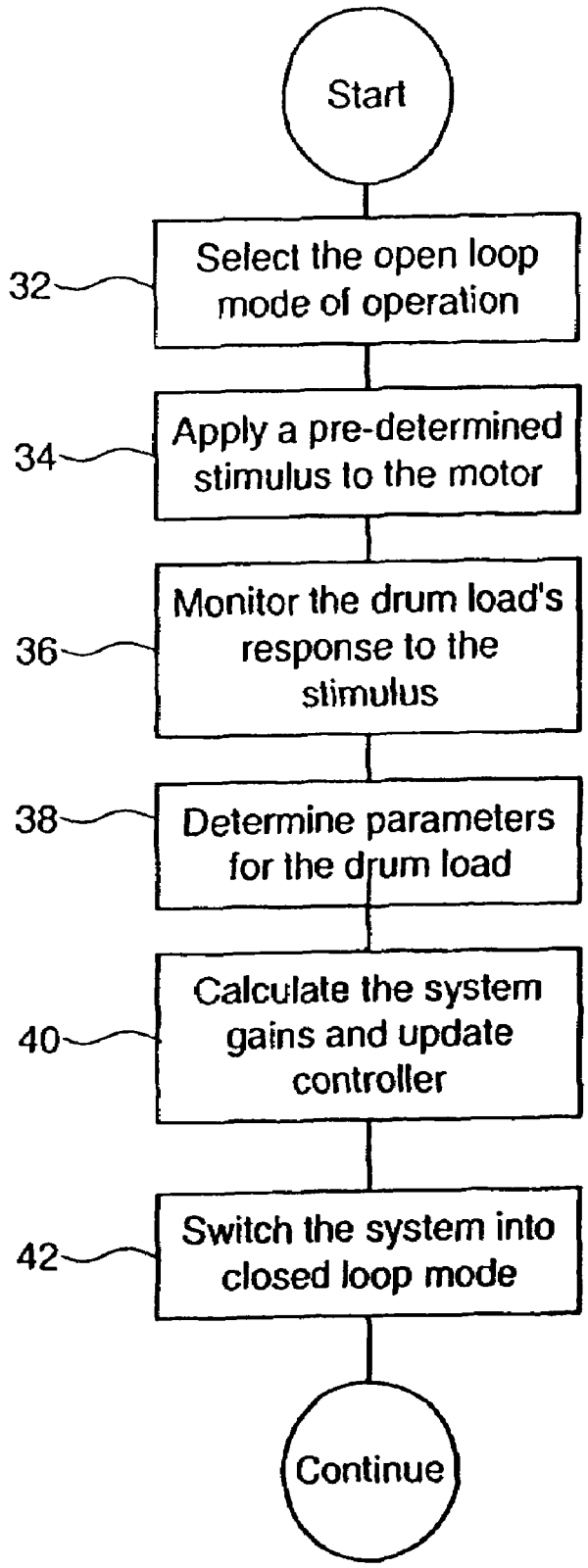
FIG. 2 is a process flowchart showing a method of the present invention.

This invention is described in relation to an imaging system that automatically detects the presence of a changed drum load and changes rotational drive parameters accordingly.

A schematic diagram of a prior art example of a drum rotational drive control system is shown in FIG. 1-A. A drum 10 for carrying an imaging media 12 is rotated about an axis 14 via motor drive 16. Drive is provided to drum 10 via a belt 18 and pulley 20. The actual rotational speed is sensed by an encoder 22 which may be a commonly-available optical shaft encoder. The output of the shaft encoder 22 is connected to drum controller 24. Drum controller 24, via servo amplifier 26, provides drive current to motor 16. Servo amplifier 26 provides an interface between drum controller 24 and motor 16, since the controller will typically comprise logic circuitry, incapable of delivering the high power required by the motor 16. Drum controller 24 may also be interfaced to a system controller 28 or there may be a single system controller in which the functions of drum controller 24 and system controller 28 are merged. The system controller 28 typically manages the functions of the imaging system including, for example, issuing a command to rotate the drum at some pre-determined speed.

The control loop corresponding to the physical system of FIG. 1 is shown in schematic form in FIG. 1-B. The drum controller 24 receives an instruction to rotate the drum at a specific speed from the system controller 28. The drum controller 24 is essentially a computer that is programmed with a control algorithm. It could also be a hardware-implemented controller, but the flexibility of using a programmable controller makes such a device the natural choice for constructing an easily adapted system. The drum controller has a set of parameters stored in memory defining the physical system to be driven. These parameters may be parameters like the inertia of the drum load, the motor torque constant, the encoder resolution etc. The drum controller may store these parameters directly or a set of computed system gains may be stored instead. In closed loop operation the drum controller attempts to control the drive system to produce the speed requested by system controller 28 by monitoring the actual speed of the drum load 10 provided by encoder 22 and constantly correcting for deviations. The algorithm uses the system gains or parameters to affect the control. Should one of these parameters, e.g. drum inertia be wrong, the drum speed may not be controllable. Additionally while embodiments are described with reference to speed control, positional control is also important in imaging systems and the concepts described herein should be understood to cover both speed and position control.

A different drum load 10 may be accommodated by changing, for example, the inertia parameter in the controller algorithm. The parameter may be entered by an operator via a user interface to system controller 28. In this case, the user would have to know what the parameters for the new drum are, and correctly enter these into the system. A possibility of error exists, even if it is made simple for the operator by providing a list or menu of different drum sizes.

In the present invention a drive parameter estimator determines suitable parameters for driving the drive conditions. The parameters may be chosen and updated without the need for manual user input.

In a preferred embodiment of the method of the present invention, the required parameters are determined with the servo system running in the open loop mode. In the open loop mode, the feedback provided to the controller 24 by encoder 22 is ignored. A process flowchart of the method is shown in FIG. 2. As a precursor to the process, an open loop mathematical model of the system is derived from knowledge of the characteristics of the various components in open loop operation. Such an analysis is well known in the art.

The first step 32 puts the system into the open loop mode. This mode is simply implemented as a function in the drum controller that configures the algorithm to ignore the encoder feedback. In step 34, a pre-determined stimulus is applied to the motor 16 by the drum controller 24 (via the servo amplifier 26). In the preferred embodiment, the stimulus is simply the application of a fixed current to the motor 16, producing a substantially fixed torque. The motor transmits the stimulus to the drum load 10 via the drive belt 18 and in step 36 the encoder 22 monitors the instantaneous velocity of the drum load. In the preferred embodiment the encoder 22 outputs a stream of electrical pulses corresponding to an optical scale, the pulse width and spacing reducing as the rotational speed of the drum increases. The drum controller monitors velocity as a function of time in one or more state variables. These state variables are accumulated in controller memory for later analysis.

Once the state variables have been accumulated for a particular stimulus, the stimulus is removed. In step 38 the parameters are computed or estimated. For a constant torque stimulus the inertia of the drum, J is given by the simplified expression:

$$J = \frac{T}{\alpha} \qquad \text{Eqn. 1}$$

where T is the value of the constant torque applied and $\alpha$ is the rotational acceleration of the drum load. In the above expression secondary factors such as back emf, frictional losses, windage and the effect of the belt drive have been ignored. The inertia J calculated will be an effective inertia, which is dominated by the drum load inertia, but may include other secondary effects as well. The inclusion of these secondary effects in the calculation, albeit in a simplified model, is desirable since component tolerances may at least partially be accounted for.

Figure 3:
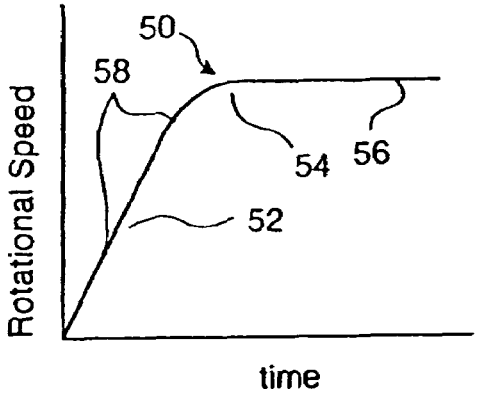
FIG. 3 is a graphical depiction of the response of a drum to a constant torque stimulus.

The state variables accumulated while the stimulus is applied are then post-processed to calculate the acceleration. The calculation process is illustrated with reference to the graph of FIG. 3, plotting the rotational speed against time. Under conditions of constant torque, the speed profile 50 will typically have three distinct portions although for calculation of inertia only the first portion 52 of the profile is of interest. In portion 52 there is an almost linear increase in rotational speed (constant acceleration). In the portion 54 friction, windage and the back emf of the motor 16 come into play reducing the acceleration and in portion 56 the velocity reaches a constant plateau.

The inertial estimation is made by calculating the slope of portion 52, which corresponds to the rotational acceleration $\alpha$. This could be simply taken as the slope between two points 58 or may be a more complex least squares determination if the portion 52 deviates more substantially from a linear function. In the preferred embodiment, the two-point method has been found to be quite satisfactory. Eqn. 1 is then applied to calculate the effective inertia J. The value of J is be used to calculate the system gains which are then updated to the new values in step 40. The system is switched back into closed loop mode for further operation under normal closed loop control in step 42. The system is ready to continue with normal operation, the drum load being correctly accommodated by the system without operator intervention.

Typically, when a drum load change is made the imaging system controller will be made aware that the change has occurred. The system is programmed to perform the method of FIG. 2 before attempting to spin the changed load under closed loop control. This method of characterizing a load is commonly referred to as parameter or system identification.

In an alternative embodiment, a varying stimulus may be used to more precisely characterize the system parameters for a particularly sensitive control system. However, it has been found that this is not necessary for imaging systems that have been analysed to date.

Figure 4:
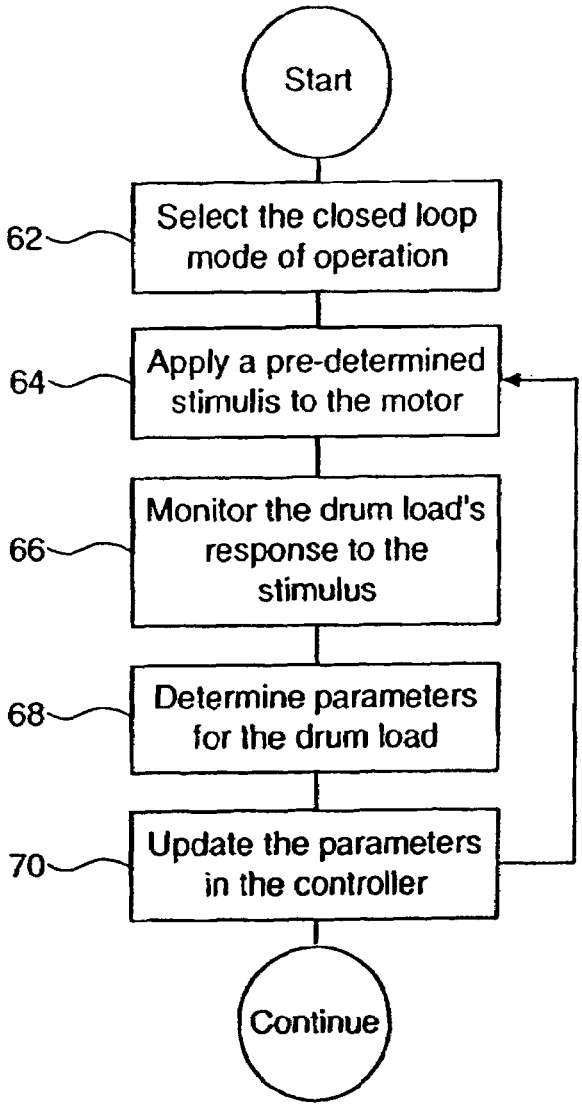
FIG. 4 is a process flowchart showing another method of the present invention.

In another embodiment of the method of the present invention, the parameters may be determined under closed loop operation using an adaptive control algorithm. This method is outlined in the process flowchart in FIG. 4. In step 62 the system is put under closed loop control i.e. the encoder signal is constantly fed back to the drum controller, which in turn corrects the drive conditions to achieve the desired rotation. In step 64 a stimulus is applied to the drum—this may be as simple as an instruction from system controller 28 to spin the drum load to some pre-determined speed. Steps 64 to 70 are similar to those described for the FIG. 2 embodiment but in this case the control system is under closed loop control. Another difference is that the process is continuous and steps 64-70 repeat, at least while the determination is being done. This process is well known in the art as adaptive control.

A few options exist for implementing this technique. Firstly, the control system may be continuously run under adaptive control. Alternatively, the system may be run in a learning mode where the parameters are determined, whereafter the adaptive control is removed and the system continues under normal closed loop feedback control. The switchover between the feedback control with adaptive control to simple feedback control may be done by stopping the drum and restarting under feedback control or by doing a switchover while running.

As will be apparent to those skilled in the art in the light of the foregoing disclosure, many alterations and modifications are possible in the practice of this invention without departing from the spirit or scope thereof. Specifically, while the system has been described in relation to a programmable drum controller the drum controller may also be implemented in hardware or with discrete components. In such a case, switching into the open loop mode may involve breaking of connections using switches, relays, or solid-state switches. The actual computation may vary depending on the stimulus provided and may result in determination of just the inertia of the drum load or it may also provide estimates for a plurality of parameters such as damping coefficient, torque constant, resonant modes etc. The drive means for imparting a rotation to the drum, while generally described herein as a belt drive, may take on many forms such as, for example, a directly applied drive where the motor shaft is connected directly to the drum axis.

What is claimed is:

1. A method for accommodating different drum loads in an imaging system, the method comprising steps:

a) selecting a drum load from a plurality of drum loads;

b) applying a drive stimulus to the selected drum load;

c) monitoring a response of the selected drum load to the stimulus;

d) determining from the response a new value for at least one control parameter for driving the selected drum load, the at least one control parameter varying for each of the plurality of drum loads; and e) updating the at least one control parameter in accordance with the new value.

2. A method for accommodating different drum loads in an imaging system, the method comprising:

applying a drive stimulus to a drum load;

monitoring a response of the drum load to the drive stimulus;

determining a new value for at least one control parameter for driving the drum load; and updating the control parameter in accordance with the new value;

wherein the drive stimulus is a pre-determined drive stimulus.

3. A method according to claim 2, wherein the pre-determined drive stimulus is a constant torque.

4. A method according to claim 2, wherein the pre-determined drive stimulus is a varying torque.

5. A method according to claim 1, wherein steps (c) to (e) are performed under closed loop feedback control.

6. A method according to claim 1, wherein steps (a) to (e) are performed under open loop feedback control.

7. A method according to claim 6, wherein steps (c) to (e) are iteratively repeated.

8. A method according to claim 7, comprising, after iteratively repeating steps (c) to (e) a plurality of times, discontinuing the iterative repetition of steps (c) to (e).

9. A method for accommodating different drum loads in an imaging system, the method comprising:

applying a drive stimulus to a drum load;

monitoring a response of the drum load to the drive stimulus;

determining a new value for at least one control parameter for driving the drum load; and updating the control parameter in accordance with the new value;

wherein the monitoring the response of the drum load to the stimulus is performed by optical means.

10. A method for accommodating different drum loads in an imaging system, the method comprising:

applying a drive stimulus to a drum load;

monitoring a response of the drum load to the drive stimulus;

determining a new value for at least one control parameter for driving the drum load; and updating the control parameter in accordance with the new value;

wherein the parameter is effective drum inertia.

11. A method according to claim 10, wherein the effective drum inertia is calculate according to the formula:

$J=T/\alpha$ where T is the value of a constant torque stimulus applied to the drum and $\alpha$ is the rotational acceleration calculated from the monitored response of the drum load to the drive stimulus.

12. A system for driving a drum load in an imaging system, comprising:

a drum drive for driving a drum load selected from a plurality of associated drum loads;

a drive stimulus to apply a stimulus to the selected drum load;

a monitor for monitoring a response of the selected drum load to the stimulus;

an encoder for sensing the resulting rotation of the selected drum load to the stimulus; and a controller operably connected to the drum drive to provide control signals thereto, the control signals derived by the controller in response to rotational information received from the encoder, the controller having a drive parameter estimator for determining one or more new drive parameter values for driving the selected drum, the one or more drive parameters varying for each of the plurality of drum loads including a parameter defined by relationship which relates the control signals to a state of rotation of the selected drum load.

13. A system for driving a drum load according to claim 12, wherein the drive parameter estimator comprises instructions stored in computer readable memory.

14. A system for driving a drum load according to claim 12, wherein the drive parameter estimator comprises an adaptive controller.

15. A system for driving a drum load the system comprising:

a drum drive for driving a drum, the drum having an associated drum load;

an encoder for sensing resulting rotation of the drum; and a controller operably connected to the drum drive to provide control signals thereto, the control signals derived by the controller in response to rotational information received from the encoder, the controller having a drive parameter estimator for determining suitable drive conditions for the drum load;

wherein the controller is adapted to switch between an open loop and a closed loop control mode, and the drive parameter estimator determines suitable drive conditions for the drum load in the open loop mode.

16. A system for driving a drum load the system comprising:

a drum drive for driving a drum, the drum having an associated drum load;

an encoder for sensing resulting rotation of the drum; and a controller operably connected to the drum drive to provide control signals thereto, the control signals derived by the controller in response to rotational information received from the encoder, the controller having a drive parameter estimator for determining suitable drive conditions for the drum load;

wherein the controller is adapted to switch between an open loop and a closed loop control mode, and the drive parameter estimator determines suitable drive conditions for the drum load in the closed loop mode.

17. A system according to claim 12 wherein the controller is adapted to switch between an open loop control mode and a closed loop control mode.

18. A system according to claim 12 comprising a memory accessible to the controller wherein the drive parameters determined by the drive parameter estimator are stored in the memory.

19. A system according to claim 12 wherein the relationship comprises a model for estimating the state of rotation of the drum in response to given control signals.

20. A system according to claim 12 wherein the one or more drive parameters comprise an effective drum inertia.

21. A method according to claim 1 comprising determining values for a plurality of control parameters.

22. A method according to claim 1 wherein the at least one control parameter comprises one or more of: an effective inertia, a damping coefficient, and a torque constant.

23. A method according to claim 1 comprising storing state variables representing the response of the drum load to the stimulus and performing step c) after removing the stimulus.

24. A method according to claim 1 wherein the at least one control parameter comprises at least one parameter of a model for estimating the state of rotation of the drum load in response to a given torque.

25. A method according to claim 1 wherein the at least one control parameter comprises an effective drum inertia.

26. A method for accommodating different drum loads in an imaging system, the method comprising:

(a) applying a drive stimulus to a drum load;

(b) monitoring a response of the drum load to the drive stimulus;

(c) determining from the response a new value for at least one control parameter, the at least one control parameter including a relationship which relates an output of a drum controller for driving the drum load to a state of rotation of the drumload;

(d) updating the at least one control parameter in accordance with the new value;

(e) performing steps a) to d) under an open loop feedback control wherein steps b) to d) are iteratively repeated; and (f) after iteratively repeating steps b) to d) a plurality of times discontinuing the iterative repetition of steps b) to d).

27. A system for driving a drum load comprising:

a drum drive for driving a drum, the drum having an associated drum load;

an encoder for sensing resulting rotation of the drum; and a controller operably connected to the drum drive to provide control signals thereto, the control signals derived by the controller in response to rotational information received from the encoder, the controller having a drive parameter estimator for determining one or more drive parameters suitable for the drum load, the one or more drive parameters including a relationship which relates to the control signals to a state or rotation of the drum wherein the relationship comprises a model for estimating the state of rotation of the drum in response to given control signals.

28. A system for driving a drum load comprising:

a drum drive for driving a drum, the drum having an associated drum load;

an encoder for sensing resulting rotation of the drum;

a controller operably connected to the drum drive to provide control signals thereto, the control signals derived by the controller in response to rotational information received from the encoder, the controller having a drive parameter estimator for determining one or more drive parameters suitable for the drum load, the one or more drive parameters including a relationship which relates to the control signals to a state of rotation of the drum wherein the one or more drive parameters includes a model for estimating the state of rotation of the drum in response to a given torque applied to the drive drum.

29. A system for driving a drum load comprising:

a drum drive for driving a drum, the drum having an associated drum load;

an encoder for sensing resulting rotation of the drum; and a controller operably connected to the drum drive to provide control signals thereto, the control signals derived by the controller in response to rotational information received from the encoder, the controller having a drive parameter estimator for determining one or more drive parameters suitable for the drum load, the one or more drive parameters including a relationship which relates the control signals to a state of rotation of the drum wherein the one or more drive parameters comprise an effective drive inertia.

30. A method for accommodating different drum loads in an imaging system, the method comprising:

(a) applying a drive stimulus to a drum load;

(b) monitoring a response of the drum load to the drive stimulus;

(c) determining from the response a new value for at least one control parameter, the at least one control parameter including a relationship which relates an output of a drum controller for driving the drum load to a state of rotation of the drum load; and (d) updating the at least one control parameter in accordance with the new value wherein at least one control parameter comprises one or more of an effective inertia, a damping coefficient; and a torque constant.

31. A method for accommodating different drum loads in an imaging device imaging system, the method comprising:

(a) applying a drive stimulus to a drum load;

(b) monitoring a response of the drum load to the drive stimulus;

(c) determining from the response a new value for at least one control parameter, the at least one control parameter including a relationship which relates an output of a drum controller for driving the drum load to a state of rotation of the drum load;

(d) updating the at least one control parameter in accordance with the new value;

the updating step comprising storing state variables representing the response of the drum load to the stimulus and performing step c) after removing the stimulus.

32. A method for accommodating different drum loads in an imaging system, the method comprising:

(a) applying a drive stimulus to a drum load;

(b) monitoring a response of the drum load to the drive stimulus;

(c) determining from the response a new value for at least one control parameter the at least one control parameter the at least one control parameter, the at least one control parameter including a relationship which relates an output of a drum controller for driving the drum load to a state of rotation of the drum load;

(d) updating the at least one control parameter in accordance with the new value;

wherein at least one control parameter includes a model for estimating the state of rotation of the drum load in response to a given torque.

33. A method for accommodating different drum loads in an imaging system, the method comprising:

(a) applying a drive stimulus to a drum load;

(b) monitoring a response of the drum load to the drive stimulus;

(c) determining from the response a new value for at least one control parameter, the at least one control parameter including a relationship which relates an output of a drum controller for driving the drum load to a state of rotation of the drum load;

(d) updating the at least one control parameter in accordance with the new value wherein the at least one control parameter comprises an effective drum inertia.

* * * * *